United States Patent [19]

Obergfell

[11] 4,294,391

[45] Oct. 13, 1981

[54] FASTENER DRIVING TOOL

[75] Inventor: Allen R. Obergfell, Park Ridge, Ill.

[73] Assignee: Duo-Fast Corporation, Franklin Park, Ill.

[21] Appl. No.: 89,878

[22] Filed: Oct. 31, 1979

[51] Int. Cl.[3] ..... B25C 1/04

[52] U.S. Cl. ..... 227/130; 91/399; 91/403

[58] Field of Search ..... 91/399, 403, 410, 461; 222/107, 112, 114, 115, 116, 120, 130, 136

[56] References Cited

U.S. PATENT DOCUMENTS 3,162,097 12/1964 Allen et al. ..... 91/399

3,190,187 6/1965 Doyle ..... 91/403

*Primary Examiner*—Paul A. Bell

*Attorney, Agent, or Firm*—Mason, Kolehmainen, Rathburn & Wyss

[57] ABSTRACT

A tool for driving fasteners includes a casing defining a nose portion and a handle portion within which is a reservoir for pressurized fluid. A driver is mounted in the nose portion that is reciprocated by a piston attached thereto and an assembly for returning the piston to a static position after a driving stroke is also included. The return assembly includes a chamber in fluid communication through an inlet with pressurized air and with an outlet that is in communication with a location beneath the return piston. A diaphragm is mounted within the chamber and is biased by pressurized fluid into sealing engagement with the inlet and the outlet. Another metered inlet is also included in the chamber that is in fluid communication with the source of pressurized fluid and controls the sealing action of the diaphragm. The chamber for the return assembly is also in fluid communication with a second chamber within which is mounted a differential area piston. The piston includes a feed pawl for feeding fasteners to the driver from a magazine. The magazine is defined by two identical portions that are reversed upon assembly. Fasteners for the tool are fed from the magazine to the driver on a tape and each fastener is held by at least one tab. To prevent the fasteners from dislodging from the tape, the tool includes a shoe biased into engagement with the fastener and the tab.

13 Claims, 24 Drawing Figures

Fig. 3
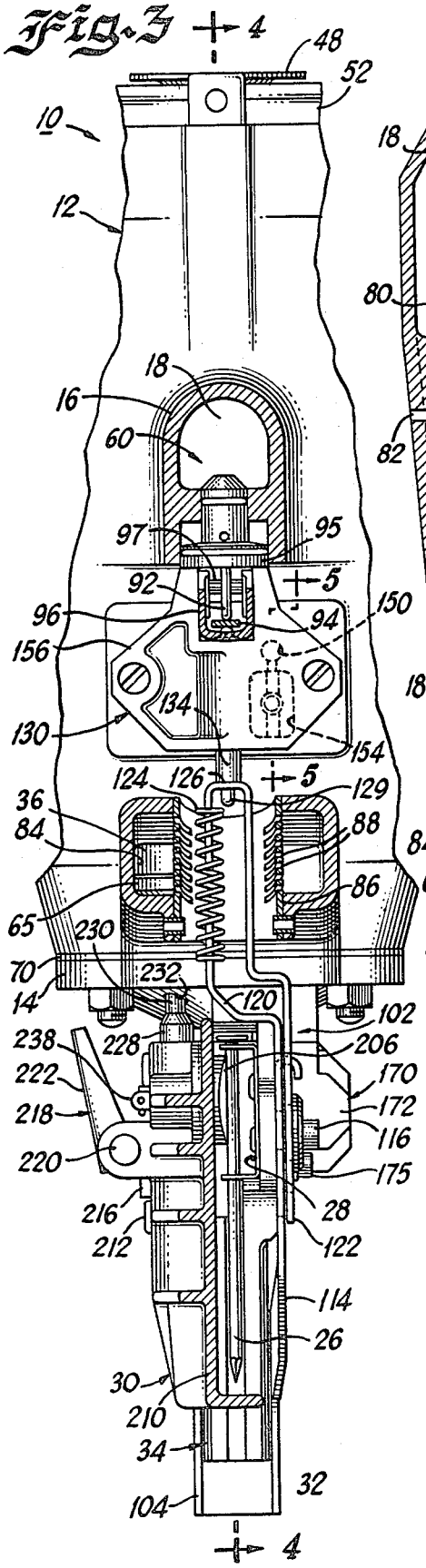
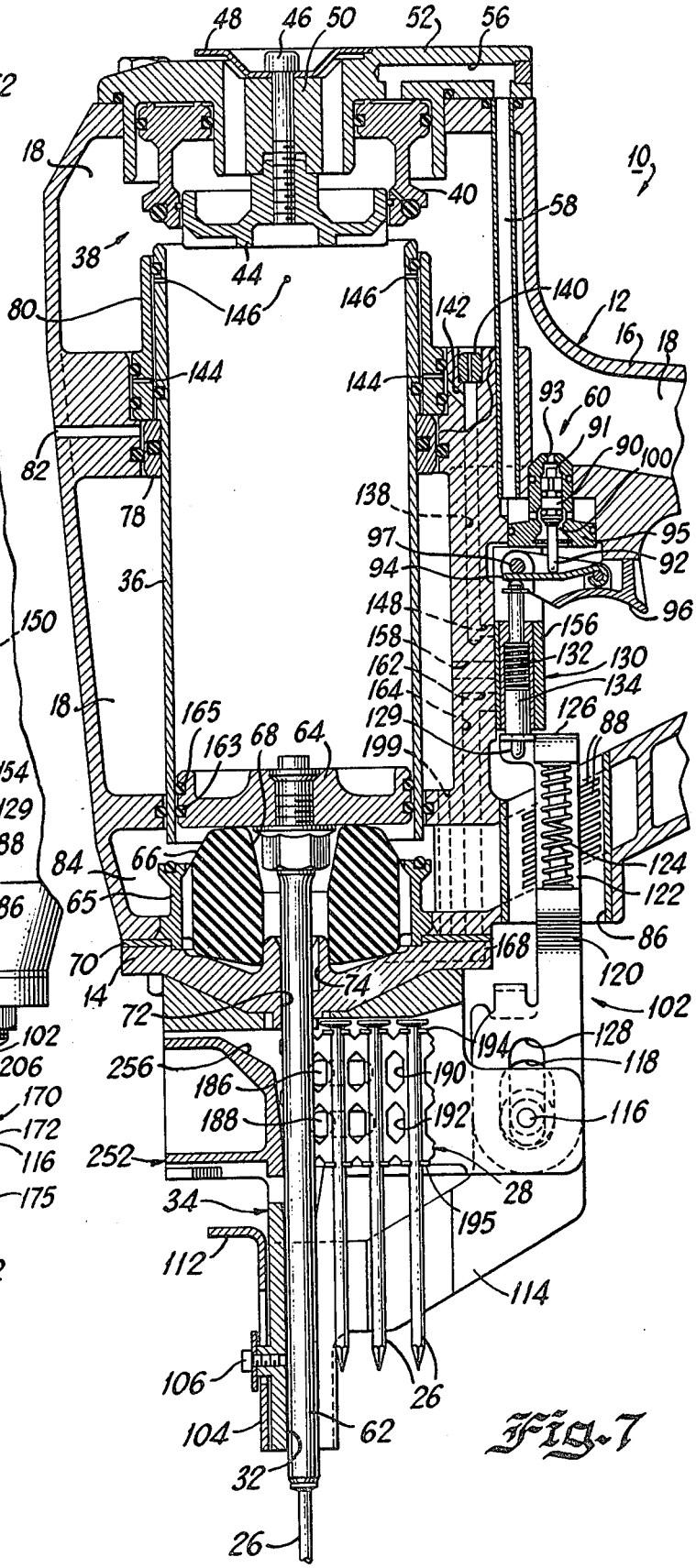
Fig. 7

10
48
46
50
52
56
54
42
42
18
44
40
38
58
146
146
142
140
80
64
165
163
12
16
144
144
93
60
18
76
91
90
82
138
78
95
97
92
94
62
36
148
156
96
158
132
130
18
162
134
88
164
126
129
66
68
74
199
84
124
65
122
70
14
168
86
194
120
72
190
102
256
186
28
188
192
116
118
252
128
195
34
112
114
106
26
32
104

12
6
130
138
161
156
18
150
148
152
166
158
162
154
167
160
164
6

138
148
158
12
130
156
162
164

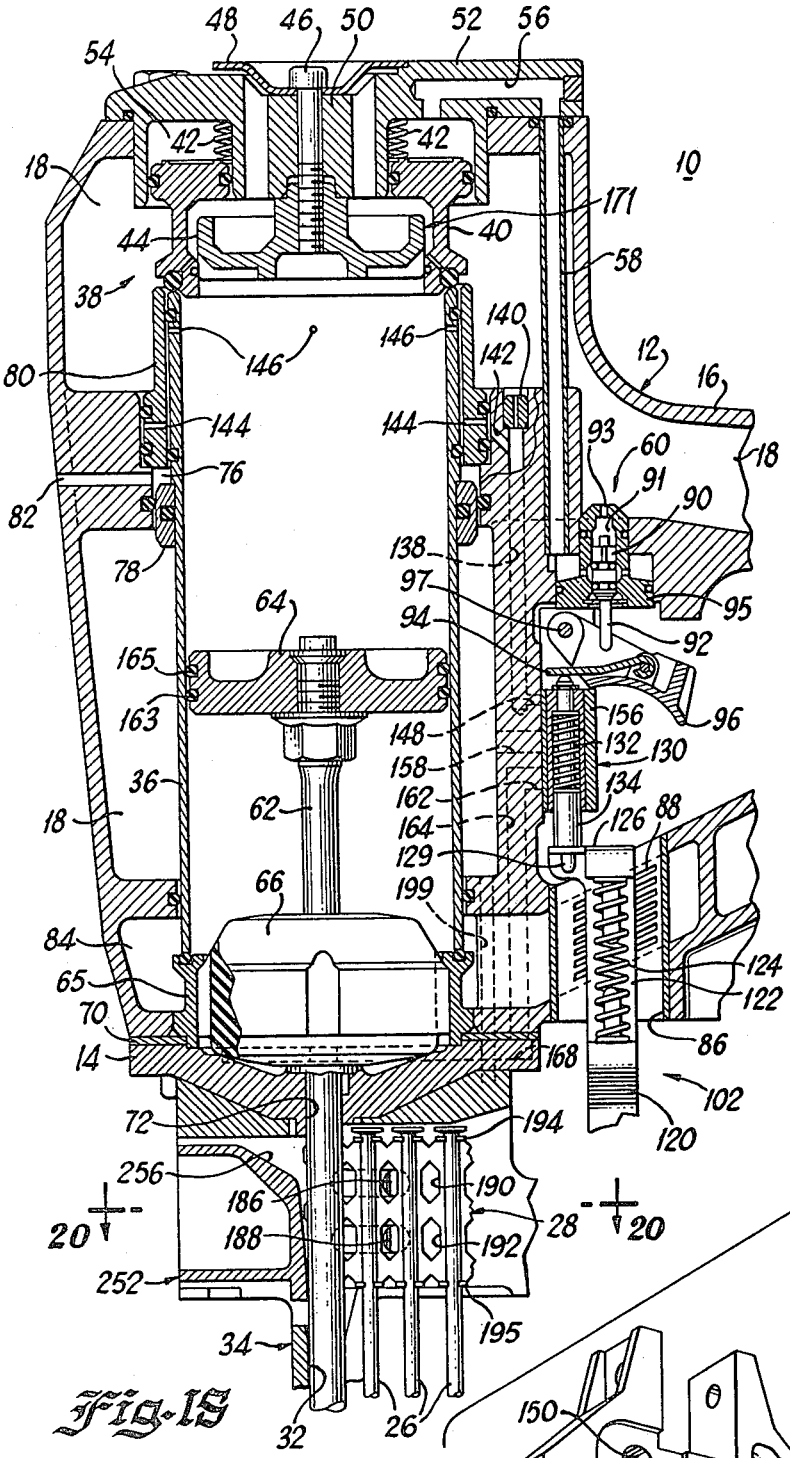
Fig. 19
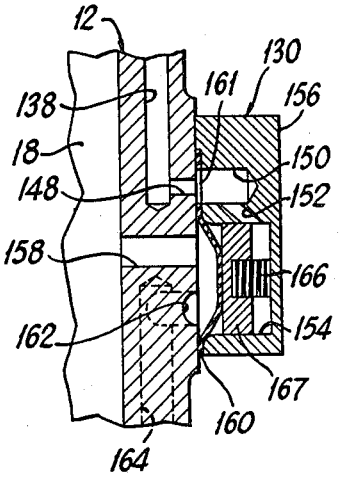
Fig. 21
Fig. 15

Fig. 22
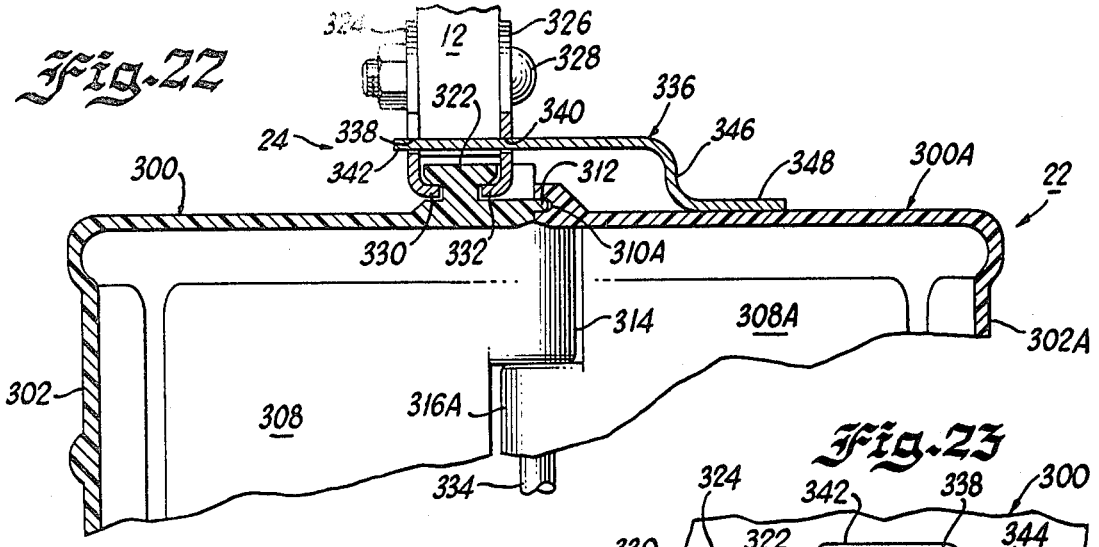
Fig. 23
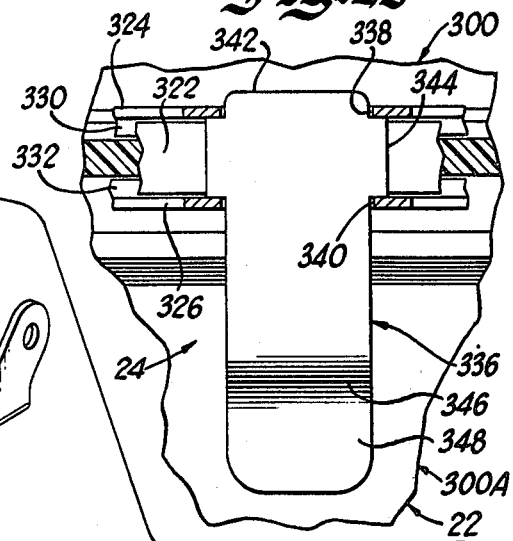
Fig. 24
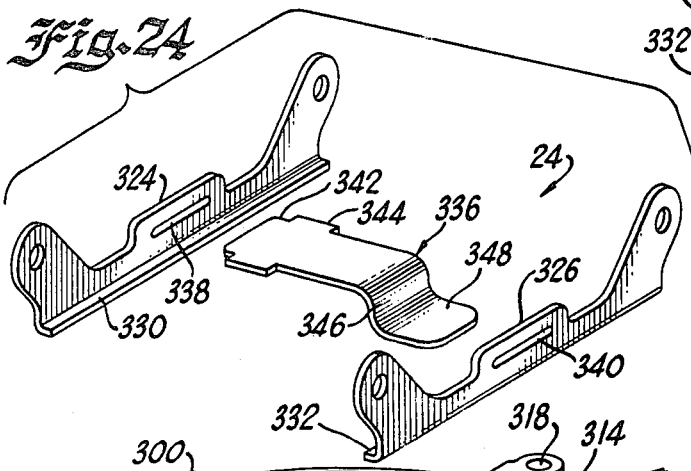
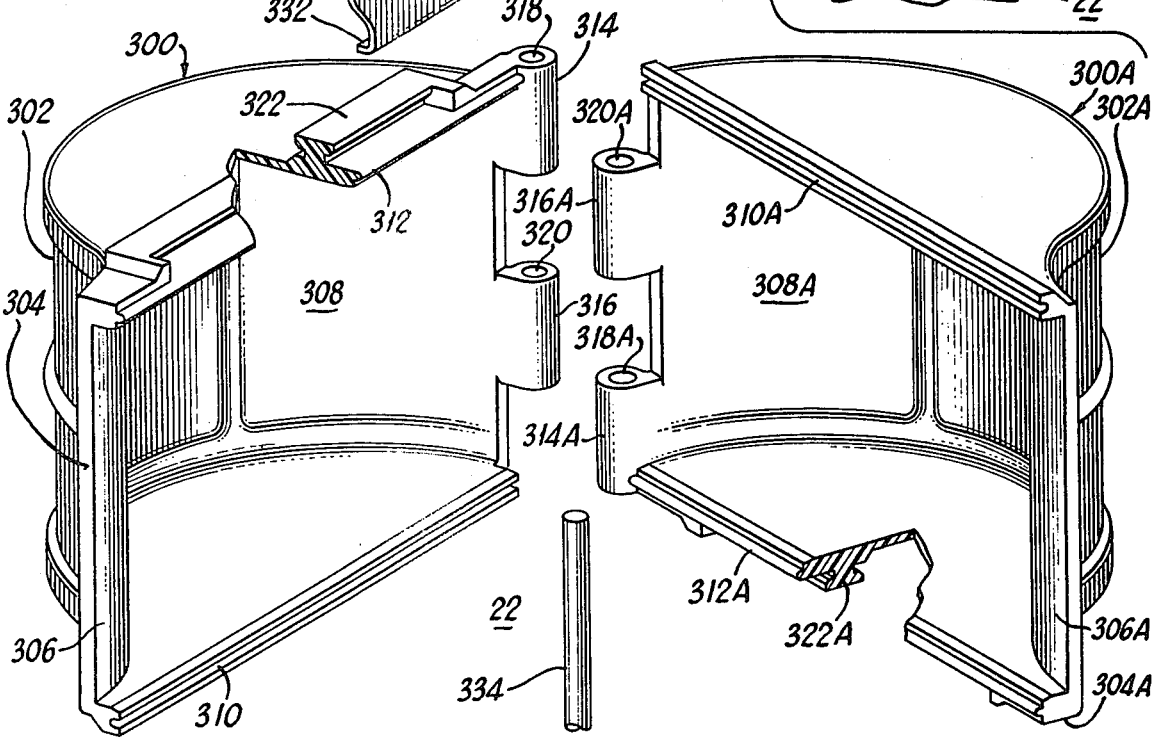

FASTENER DRIVING TOOL

BACKGROUND OF THE INVENTION

A. Field of the Invention

The present invention generally relates to a new and improved tool for driving fasteners.

B. Description of the Prior Art

In industries requiring fastener driving tools capable of driving large fasteners such as five inch nails, the tools must be capable of operating under heavy demand situations and it is desirable that the likelihood of misfiring or the driver of the tool inadvertently engaging a fastener be prevented since damage to the tool could occur. In addition, in the industrial environment, the fastener driving tool is subject to inadvertent blows to the casing and magazine. In this type of use it is desirable that the magazine assembly of the tool be of durable construction and be adaptable to continued use if slightly damaged.

It is also desirable in such prior art tools that repeated and rapid firing of the tool be possible. To this end a reliable and fast acting driver return mechanism is desired as is a feed mechanism that will feed fasteners to the driver without the misplacement of the fasteners in the drive track of the tool.

Since these prior art tools also experience some recoil due to the large fasteners and workpieces with which the tool is employed, it is desirable to provide a structure to prevent the fasteners from being inadvertently dislodged from the fastener carrier strip prior to being driven by the driver of the tool.

SUMMARY OF THE INVENTION

An object of the present invention is to provide a new and improved tool for driving fasteners into a workpiece.

Another object of the present invention is to provide a new and improved fastener driving tool including a fluid biased diaphragm controlled driver return mechanism.

The present invention is directed to a new and improved fastener driving tool including a casing defining a handle within which is a reservoir of pressurized fluid. The casing also defines a nose portion including a driver and attached piston reciprocally mounted within the casing.

A driver return mechanism is also included in the tool and includes a diaphragm biased by pressurized fluid for controlling flow of pressurized fluid to a location within the tool and beneath the piston to return the driver to the static position.

A fastener engaging mechanism is also included in the tool of the present invention to hold fasteners and to prevent their dislodgement as a result of recoil of the tool during operation. The tool of the present invention is particularly designed to drive large fasteners and includes a feed mechanism capable of feeding these large fasteners. The feed mechanism includes two pawls and an air spring biasing the feed mechanism to the static position.

The tool of the present invention is also capable of being used in an industrial environment and includes a magazine for holding fasteners that is of construction to withstand blows particularly likely to occur in an industrial environment.

BRIEF DESCRIPTION OF THE DRAWINGS

The above and other objects and advantages and novel features of the present invention will become apparent from the following detailed description of a preferred embodiment of the invention illustrated in the accompanying drawings wherein:

FIG. 3 is a view taken along line 3—3 of FIG. 1;

FIG. 7 is a view similar to FIG. 4 with the tool in the fastener driving position;

FIG. 18 is a view taken similar to FIGS. 4 and 7 with the driver in the partially returned position;

FIG. 19 is an enlarged cross sectional view of the driver return mechanism in the return position;

FIG. 20 is a view taken along line 20—20 of FIG. 18;

FIG. 21 is an enlarged exploded view of the return assembly of the present invention;

FIG. 22 is an enlarged view of the magazine taken along the line 22—22 of FIG. 1;

FIG. 23 is a view taken along line 23—23 of FIG. 1; and

FIG. 24 is an exploded view of the magazine assembly of the present invention;

DESCRIPTION OF A PREFERRED EMBODIMENT

Figures 1, 2, 2D:
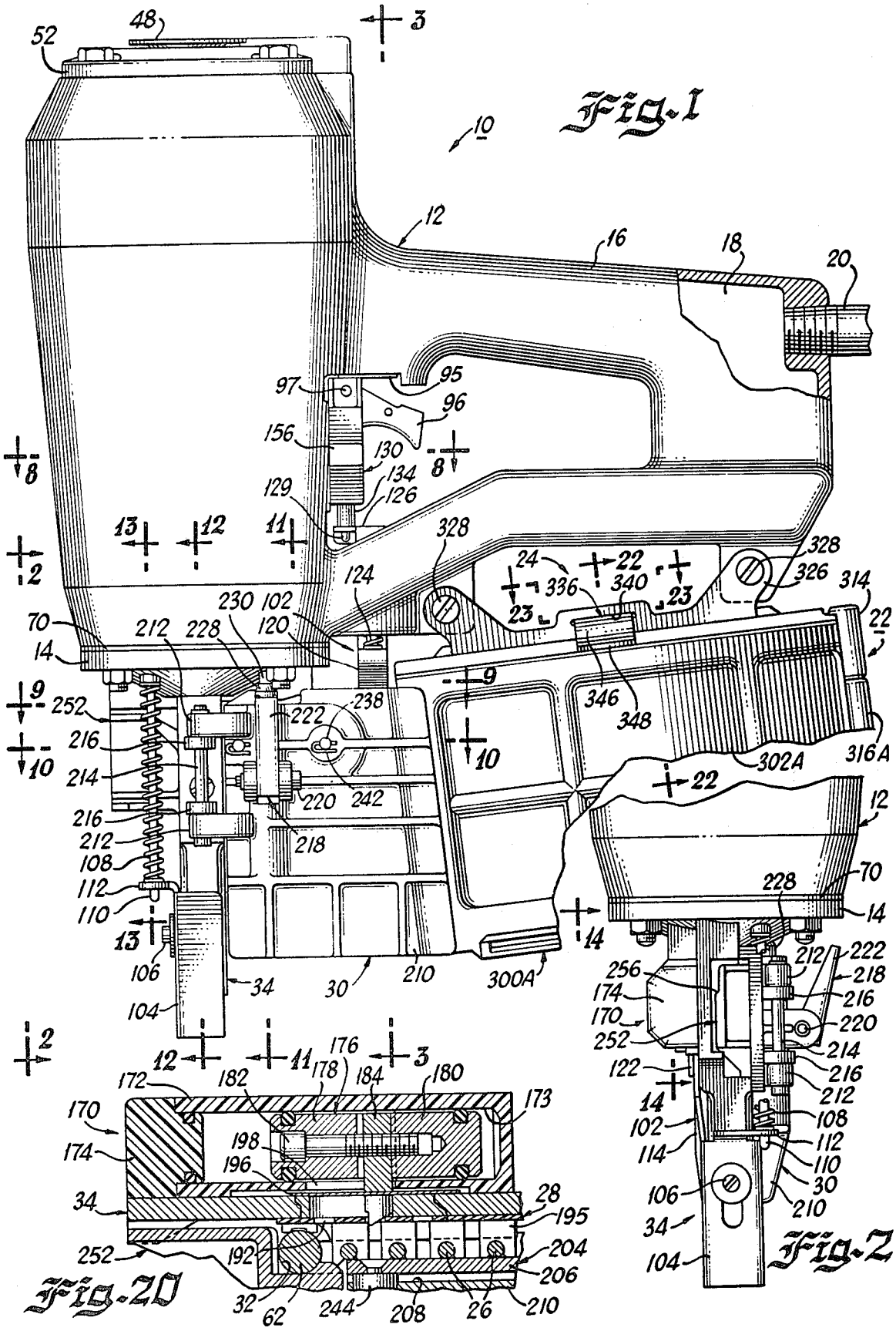
FIG. 1 is a side view of the tool constructed in accordance with the principles of the present invention.
FIG. 2 is a view taken along line 2—2 of FIG. 1.

Referring now to the drawings, there is illustrated a fastener driving tool generally designated by the reference numeral 10 that in the preferred embodiment illustrated may be employed to drive large fasteners such as five inch nails into a workpiece. It should be understood, however, that the present invention may be used in fastener driving tools of types other than for driving large fasteners as described hereinafter.

The tool 10 is of the pneumatic type defined by a casing generally designated by the reference numeral 12. The casing 12 defines a nose portion 14 and a handle portion 16 the interior of which defines a fluid reservoir 18 that is connected to a source of high pressure fluid through a hose coupling 20. A magazine assembly 22 is coupled to the handle portion 16 by a hanger bracket 24. The magazine assembly 22 is intended to contain a plurality of fasteners 26 that are held on a carrier strip 28 and fed through a gate assembly 30 to a drive track 32 defined in a drive track portion 34 that is defined on the tool 10 and depends from the nose portion 14. In manufacturing the tool 10, the casing 12 with the nose portion 14 and handle portion 16 as well as the drive track portion 34 may be fabricated as a single unit, however, it is to be understood that these parts and particularly the drive track portion 34 may be fabricated separately and joined together by bolts or the like.

Figure 4:
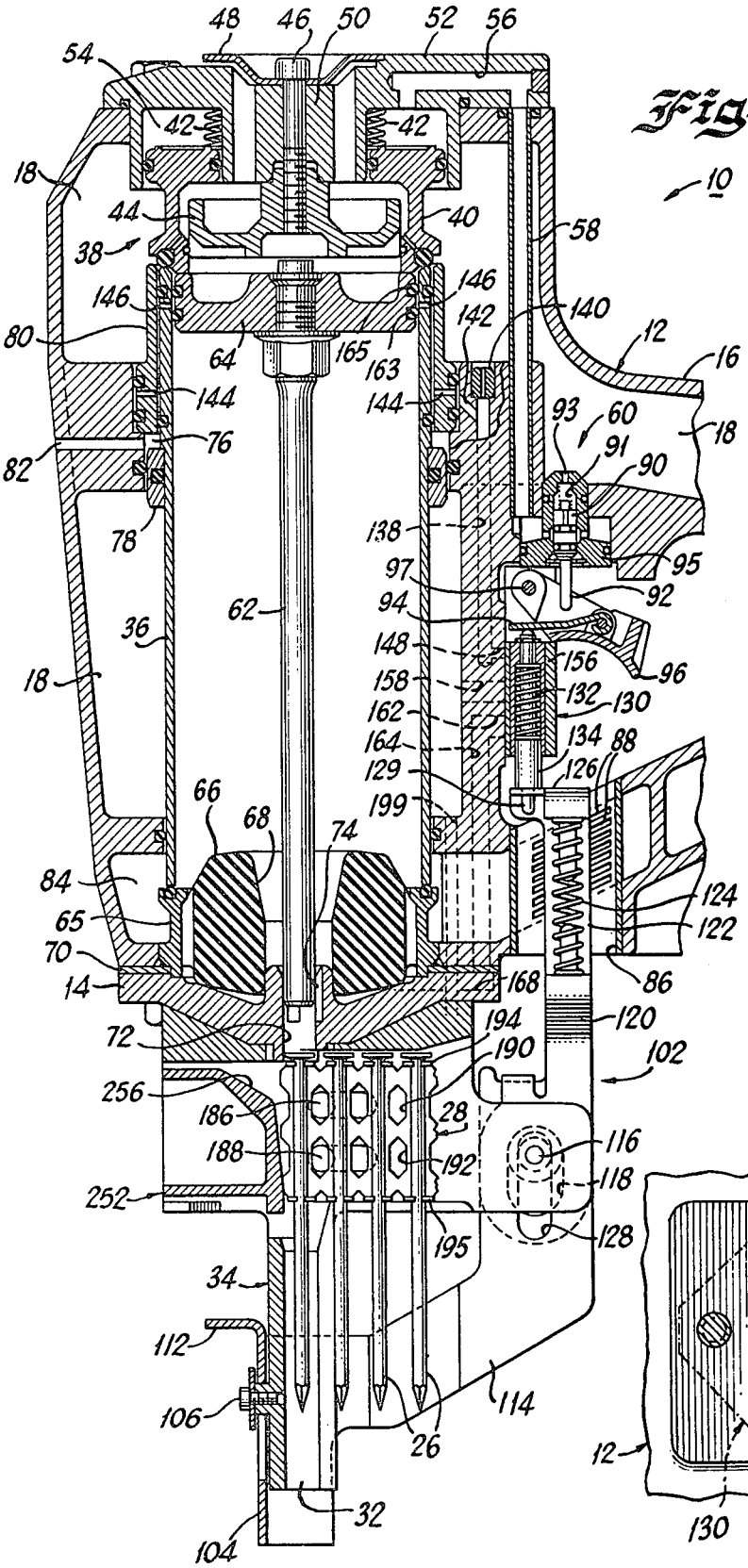
FIG. 4 is a view taken along line 4—4 of FIG. 3.

Referring now to FIG. 4, the tool 10 and the components thereof are illustrated in the static mode. More specifically, mounted within the casing 14 is a cylinder 36 that at the upper end engages a poppet assembly generally designated by the reference numeral 38. The poppet assembly 38 includes a poppet 40 biased by springs 42 to a downward position into engagement with the upper end of the cylinder 36. Mounted within the poppet 40 is an exhaust seal 44 that is connected by a bolt 46 to an exhaust deflector 48. The deflector 48 and the exhaust seal 44 are separated by spacer portion 50 of cap 52 mounted on bolt 46. The cap 52 is secured to the upper end of the casing 14 and closes off that portion of the housing 12 containing the poppet assembly 38.

A chamber 54 is defined between the cap 52 and the poppet 40 and is in fluid communication through a port 56 and a pressurized fluid tube 58 with a trigger valve generally designated by the reference numeral 60. To drive fasteners, a driver 62 is mounted within the cylinder 36 and is coupled to a driver piston 64 that in the static mode engages the poppet 40. The lower end of the cylinder 36 engages a bumper retainer ring 65 which is carried on a plate to and which retains a fluted bumper 66 that is engaged by the driver piston 64 at the completion of a driving stroke thereby preventing damage to the driver piston 64. The bumper 66 includes a central aperture 68 through which the driver 62 extends.

The bumper 66 is supported at its lower end by a plate defined on the nose 14 (FIG. 4) which includes a central aperture 72 through which the driver 62 extends and further includes slots 74 around the periphery of the aperture 72. As best seen in FIG. 4, the slots 74 vent that portion of the cylinder 36 below the driver piston 64 through the open drive track 32. The air within the cylinder 36 and below the piston 64 is rapidly vented to atmosphere at the end of the return cycle allowing the tool 10 to drive the next fastener.

To understand the operation of the cylinder 36, the poppet assembly 38, the driver 62 and the driver piston 64 reference is made to FIG. 7, wherein the tool 10 is illustrated at the completion of a driving stroke. To commence a driving stroke, the chamber 54 above the poppet 40 is vented to atmosphere by the trigger valve 60. Once this occurs, fluid pressure from the reservoir 18 acting on the lower surface of the poppet 40 moves the poppet 40 upward against the springs 42 to the position illustrated in FIG. 7. This action moves the poppet 40 out of sealing engagement with the upper edge of the cylinder 36 thereby introducing the pressurized fluid above the piston 64. The pressurized fluid drives the piston 64 and the driver 62 downward until the piston 64 engages the bumper 66 as illustrated in FIG. 7. A space 76 (FIG. 4) between a bias ring 78 mounted on the cylinder 36 and a sleeve 80 also mounted on the cylinder 36 and above the bias ring 78 is vented by way of a passage 82 and once the poppet 40 is elevated, pressurized fluid from the reservoir 18 acts against the bias ring 78 to move the cylinder 36 upwardly out of engagement with the bumper retainer ring 65. That portion of the cylinder 36 below the driver piston 64 is then placed in communication with a chamber 84 that is in fluid communication with the atmosphere through a muffler 86 and apertures 88. This movement of the cylinder 36 further reduces back pressure that would inhibit the downward movement of the piston 64 and the driver 62.

As previously described, to actuate the tool 10, the chamber 54 is vented by the trigger valve 60 (FIGS. 4 and 7). More specifically, the trigger valve 60 includes a valve element 90 with a depending extension 92 that is engaged by a lever 94 pivotally mounted on a trigger member 96. The trigger member 96 is pivotally mounted to the trigger housing 130 (to be described hereinafter) by a pin 97. As illustrated in FIG. 4, the valve 90 is biased by a spring 91 into sealing engagement with a valve cartridge 95 allowing communication through a passage 93 in the valve cartridge 95 with the reservoir 18 and to the tube 58 thereby introducing pressurized fluid to the chamber 54. Upon upward movement of the valve 90 by the trigger 96 and lever 94 as illustrated in FIG. 7, however, chamber 54 is vented to atmosphere through the tube 58 and an opening 100 defined in the valve cartridge 95 thus firing the tool 10.

Actuation of the trigger 96, however, first requires actuation of a safety assembly generally designated by the reference numeral 102. The safety assembly 102 includes a workpiece engagement portion 104 slideably mounted on the driver portion 34 by a cap screw 106 (FIG. 2). The workpiece engagement member 104 is biased downwardly to a position below the driver track portion 34 by a spring 108 (FIG. 1) that encircles a pin 110 extending through a flange 112 defined on the workpiece engagement member 104 and mounted in the lower end of the nose portion 14.

The workpiece engagement member 104 is secured to a lower yoke 114 (FIGS. 4 and 7) of the safety assembly 102 and the lower yoke 114 is slideably mounted on the nose 14 by a cap screw 116 extending through a slot 118 defined in the yoke 114. The lower yoke 114 includes an upper extending portion 120 (FIG. 3) that is connected through a lost motion connection to an upper yoke 122 of the safety assembly 102. More specifically, the lost motion connection includes a spring 124 that is secured at a lower end to the lower yoke 114 and at the upper end to the upper yoke 122.

The upper yoke 122 is also slideably connected to the nose 14 by the cap screw 116 that extends through a slot 128. The upper yoke 122 also includes a bight portion 126 with an aperture through which extends a push rod 129. The push rod 129 is biased in a downward direction by a spring 132 (FIGS. 4 and 7) mounted within a bushing 134 secured to a trigger housing 130 that may be detachably mounted to the tool 10 or may be integrally formed thereon.

When the tool 10 is not positioned against a workpiece, the trigger 96 and the safety assembly 102 are in the positions illustrated in FIG. 4. Upon placement of the tool 10 onto a workpiece, the workpiece engagement member 104, the lower yoke 114 and the upper yoke 122 are moved upwardly to the positions illustrated in FIG. 7 wherein the push rod 128 engages and pivots the trigger lever 94 upwardly into engagement with the pin 97 that pivotally mounts the trigger 96 onto the trigger housing 130. Thereafter, if the trigger 96 is pivoted, the lever 94 engages the pin 92 moving the valve element 90 upwardly to vent the tube 58 and the chamber 54 to fire the tool 10.

To return the piston 64 and driver 62 to the static position at the completion of the drive stroke, a pneumatic return system is employed. More specifically, the return system (FIG. 5) includes, in part, a first passage 138 defined in the casing 12 that is in fluid communication with the reservoir 18 through an orifice plug 140. The passage 138 is also in fluid communication through passages 142 and 144 to a space between the cylinder 36 and the sleeve 80 that in turn is in fluid communication with the interior of the cylinder 36 through the plurality of ports 146 defined in the cylinder 36. The passage 138 also communicates through ports 148, 150 and 152 with a chamber 154 defined in a return assembly housing 156 that is a part of the trigger housing 130 secured to the casing 12.

The chamber 154 is sealed and separated from passages 158 and 162 by a diaphragm 160 that includes an aperture 161 that allows communication of passages 148 and 150. Chamber 154 is also in fluid communication with fluid outlet passage 162.

The diaphragm 160 is biased into sealing engagement with the passages 158 and 162 by a shoe 167 and a spring 166 that at one end engages the shoe 167 and at the other end engages the return assembly housing 156. In the static position of the tool best illustrated in FIGS. 4 and 5, pressurized fluid from the reservoir 18 passes through the orifice plug 140 to the chamber 154 behind the shoe 167. This reservoir pressure and the force of the spring 166 acts against the bias of the fluid pressure from the passage 158 to seal the diaphragm 160 against the passages 158 and 162. At the same time, pressurized fluid is communicated to the passages 142, 144, 146 but is contained in the space between the driver piston 64 and the cylinder between a pair of O-rings 163 and 165.

Upon actuation of the trigger 96, as described above, the driver 62 is powered through a downward stroke to the position illustrated in FIG. 7. Upon release of the trigger 96 or moving the tool 10 away from the workpiece, pressurized fluid is again introduced into chamber 54 whereupon the poppet 40 moves downwardly and engages the upper end of the cylinder 36 and moves the cylinder 36 downwardly into engagement with the valve seat on the bumper retainer ring 65 (FIG. 18).

As the poppet 40 reaches its downward position, it opens an exhaust path, indicated generally at 171, to exhaust the pressurized fluid above the piston 64 or the upper end of the cylinder 36 (FIG. 18). The passages 142, 144, and 146 are now effective to vent the chamber 154 over the passage 138 by discharging pressurized air over the exhaust path 171 faster than it can be supplied through the orifice plug 140. Consequently, reservoir pressurized fluid in the passage 158 distends or moves the diaphragm 160 to the right (FIG. 19) against the bias of the spring 166.

In this position of the diaphragm 160, pressurized fluid is communicated from the passage 158 to the passages 162 and 164. The passage 164 is in fluid communication with a passage 168 defined at the top of the nose portion 14 (FIG. 8) that is in fluid communication with a passage 169 at the bottom and inside of the bumper retainer plate 70.

The movement closing the interior of the cylinder 36 and the introduction of pressurized fluid beneath the piston 64 moves the piston upwardly (FIG. 18) to the static position (FIG. 4). Once the piston 64 and the driver 62 have been returned to the static position, passages 146, 144, and 142 are again closed off by the piston 64 and pressure within the passage 138 is allowed to build up to reservoir pressure. This increased pressure returns the shoe 167 to the original position illustrated in FIG. 5, sealing the passage 158 from the passage 162.

Figure 5:
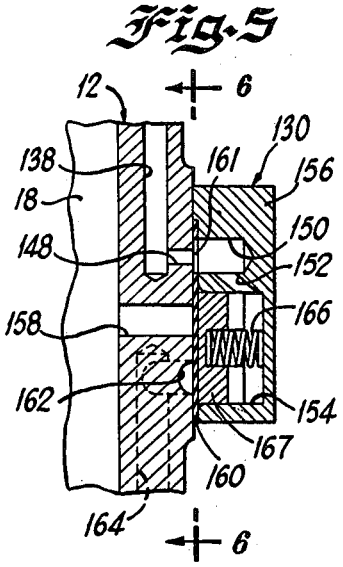
FIG. 5 is a view taken along line 5—5 of FIG. 3.
Figure 6:
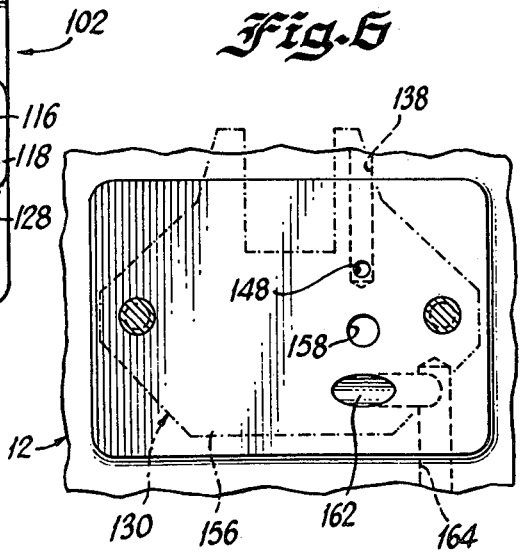
FIG. 6 is a view taken along line 6—6 of FIG. 5.

As can be seen in FIG. 5, while the shoe 167 is in the static position, in addition to biasing the diaphragm 160 into sealing engagement with the passages 158 and 162, the shoe 167 also insures that the diaphragm 160 is maintained in a flat configuration thereby preventing permanent deformation of the diaphragm 160 after prolonged use that would require its replacement. In addition, since the shoe 167 and the spring 166 force the diaphragm 160 into sealing engagement with the passages 158 and 162 while the tool is shut off, movement of the diaphragm 160 upon connection of the tool 10 to a source of pressurized fluid is avoided. For example, as the tool 10 is first connected to a source of pressurized fluid, the pressure builds up more rapidly in the passage 158 than in the passage 138 due to the orifice plug 140 thus creating a pressure pulse that could move the diaphragm 160 away from the passages 158 and 162 allowing a pulse of pressure to flow therethrough. This pulse of pressure could result in improperly feeding of a fastener 26 as will be described herein. Improper feeding in this manner however, is avoided since the spring 166 and shoe 167 provide sufficient initial bias to overcome the described pressure pulse.

Figure 10:
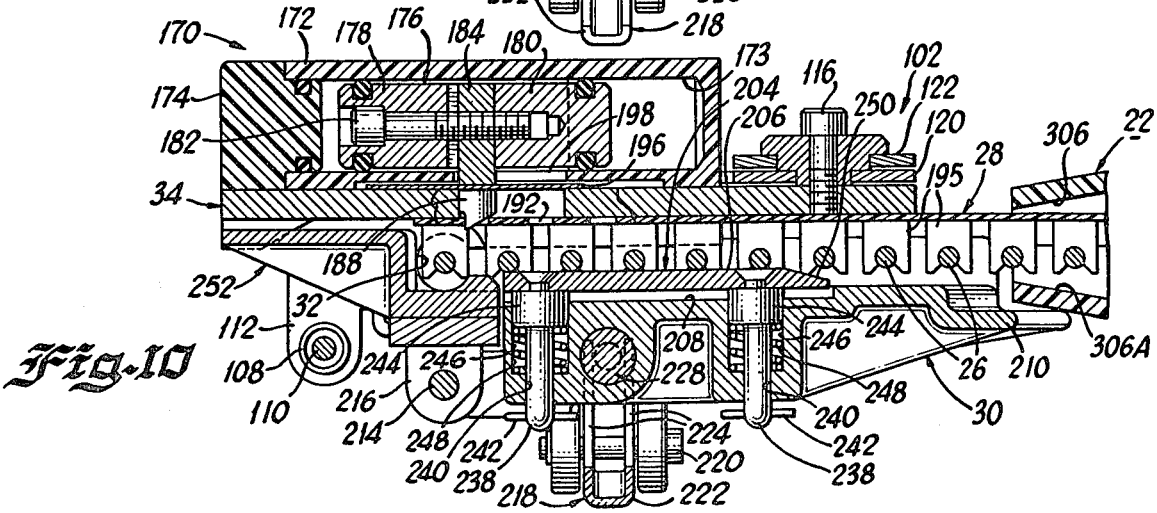
FIG. 10 is a view taken along line 10—10 of FIG. 1.
Figure 12:
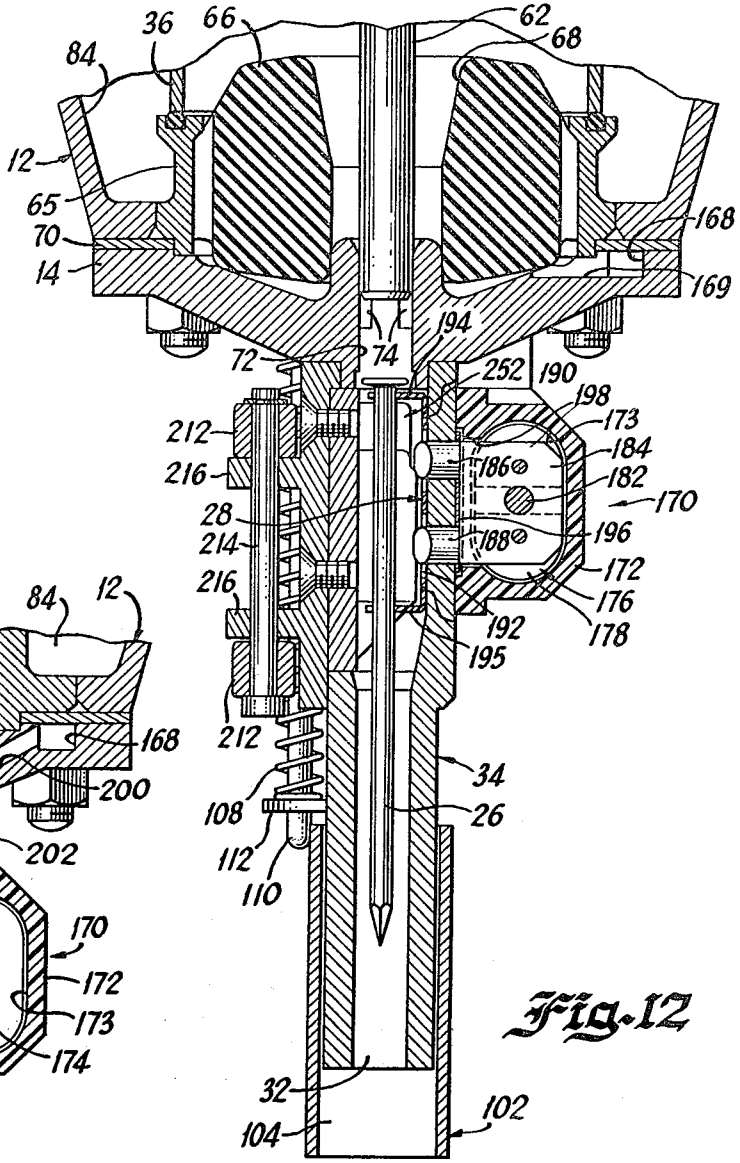
FIG. 12 is a view taken along line 12—12 of FIG. 1.
Figure 13:
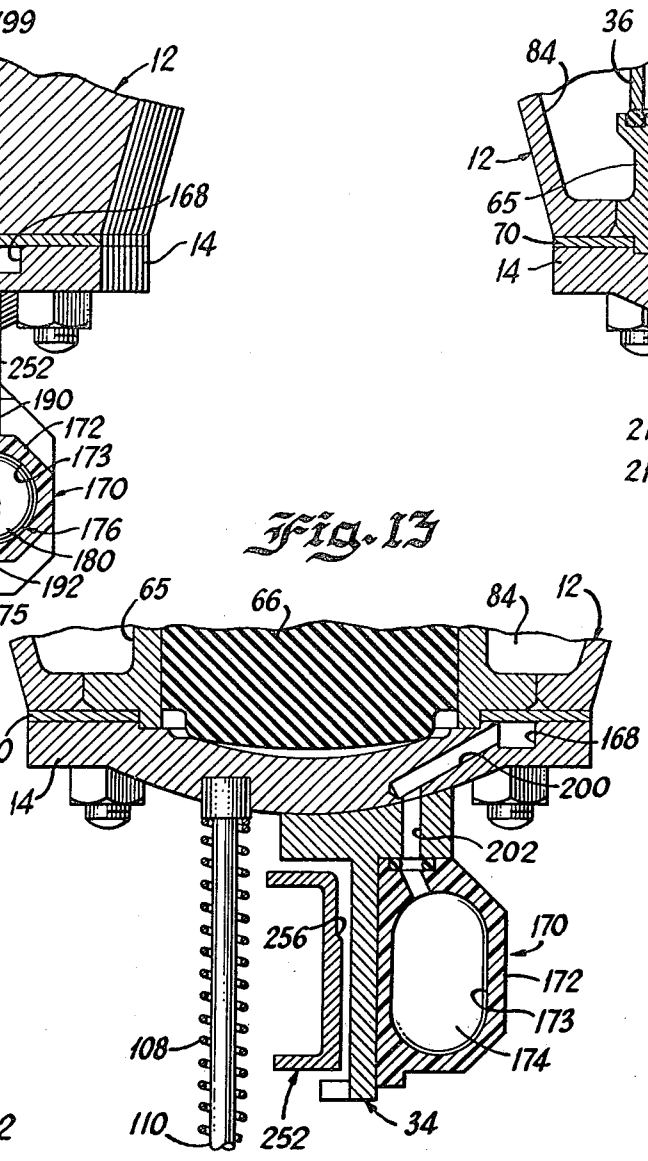
FIG. 13 is a view taken along line 13—13 of FIG. 1.
Figures 14, 15:
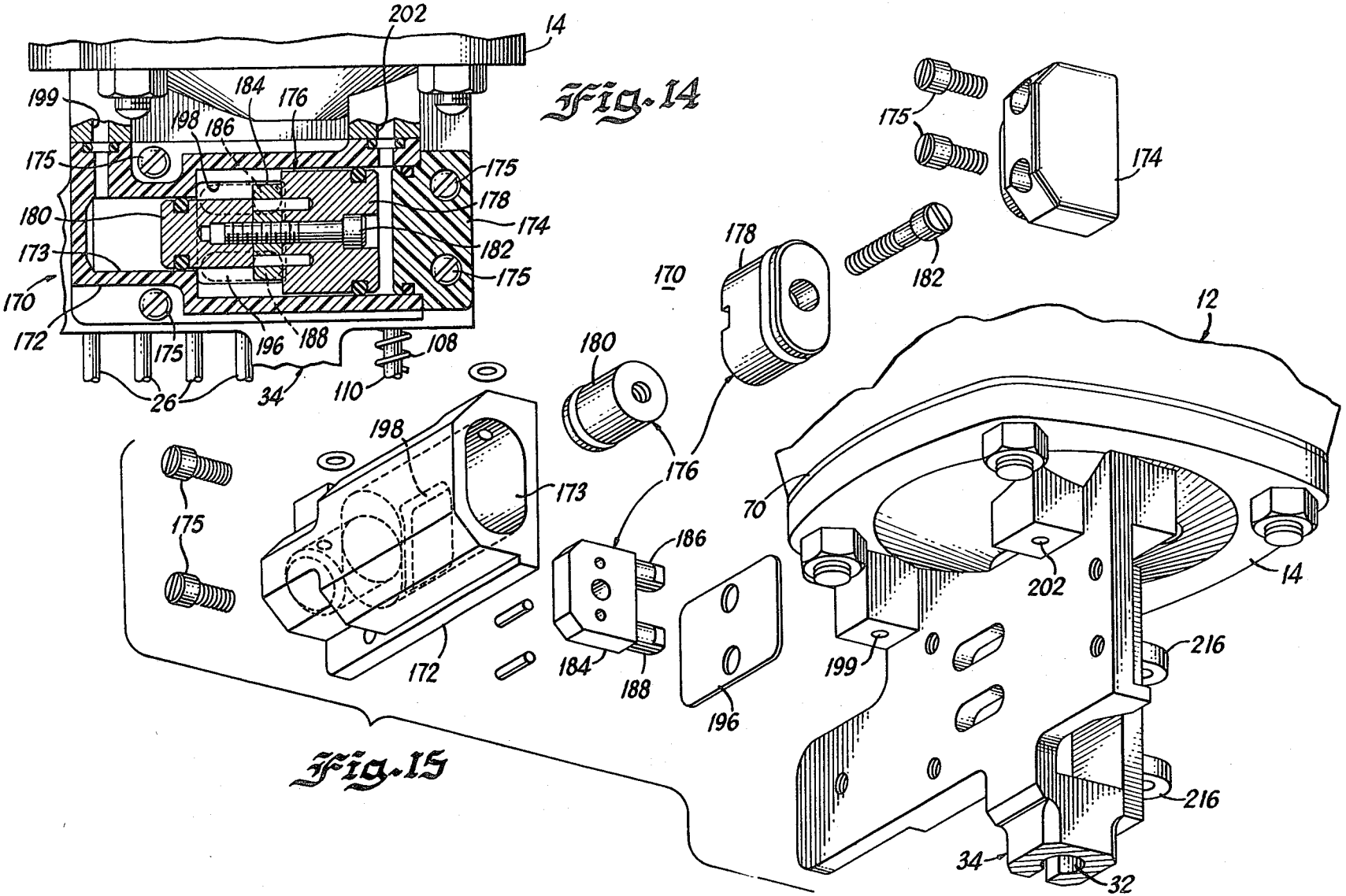
FIG. 14 is a view taken along line 14—14 of FIG. 2.
FIG. 15 is an exploded perspective view of the feed mechanism of the tool of the present invention.

During operation of the tool 10, fasteners 26 are fed from the magazine assembly 22 to the drive track 32 by a fastener feeding assembly generally designated by the reference numeral 170 (FIGS. 10, 14 and 15). Fastener feeding assembly 170 includes an open ended feed cylinder 172 that defines a chamber 173 that is closed by a seal 174 at one end thereof and may be secured to the nose 14 by fasteners 175 (FIG. 15). Reciprocally mounted within the feed cylinder 172 is a two size feed piston generally designated by the reference numeral 176 that is defined by two pistons or piston portions 178 and 180 secured together by a fastener 182 (FIGS. 10 and 15). The retraction piston 178 is of an oval cross section and of a larger cross-sectional area than the advance piston 180, which is of a circular cross section. The oval shape of the larger piston 178 saves space on the tool 10.

Mounted between the pistons 178 and 180 is a feed pawl 184 that includes first 186 and second 188 pawls that are intended to engage apertures 190 and 192 defined in the fastener carrier strip 28. The pawls 186 and 188 extend through a pawl cover or dirt shield 196 that covers an aperture 198 in the feed cylinder 172 allowing the pawls 186 and 188 to extend there through and engage the apertures 190 and 192 in the carrier 28. The plate 196 moves with the pawl 184 covering the aperture 198 and protecting the pistons 178 and 180 from dust and debris that could damage the pistons 178 and 180 and hamper the reciprocation thereof.

Figure 8:
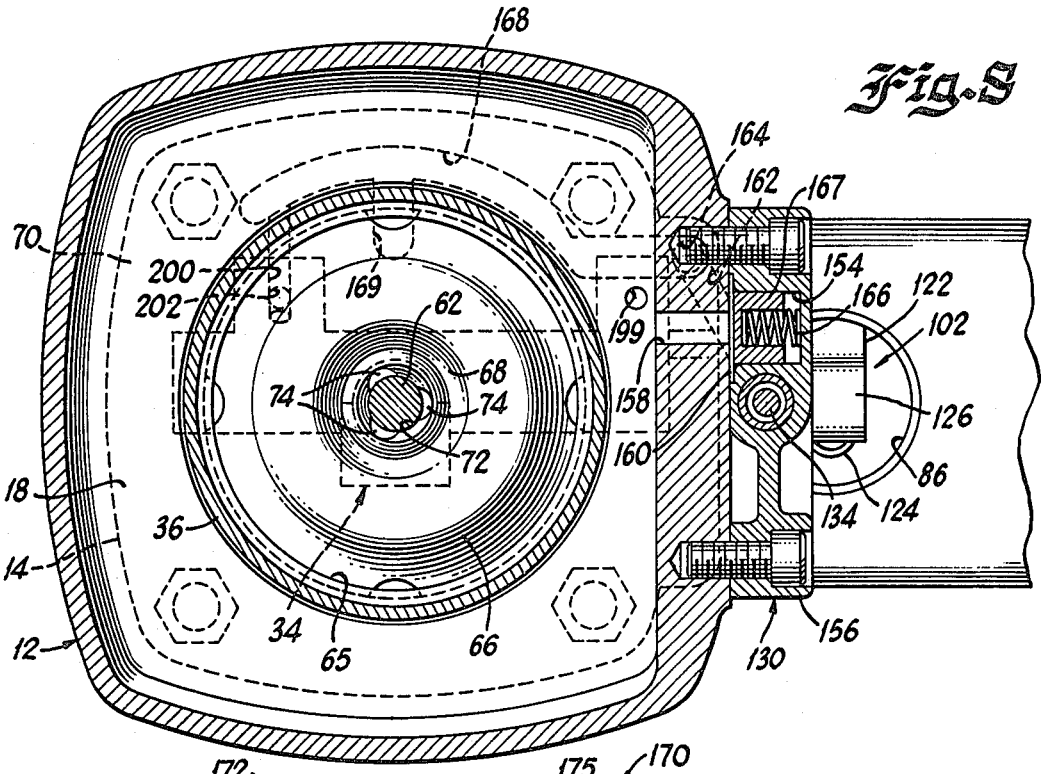
FIG. 8 is a view taken along line 8—8 of FIG. 1.
Figure 9:
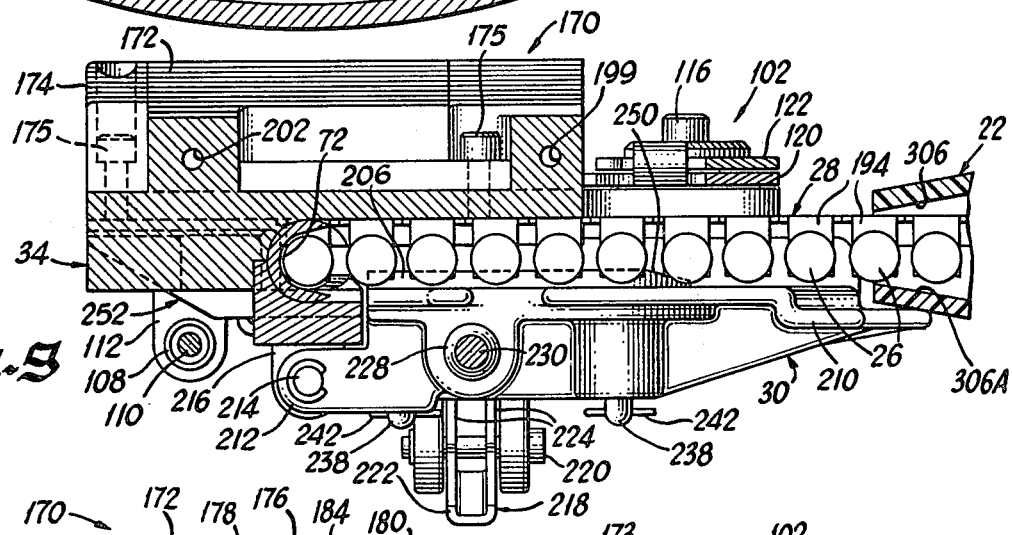
FIG. 9 is a view taken along line 9—9 of FIG. 1.

That portion of the chamber 173 between the end of the cylinder 172 and the advance piston 180 is in fluid communication with the reservoir 18 through a passage 199 (FIG. 14) that extends through the feed cylinder 172. Moreover, that portion of the chamber 173 between the retraction piston 178 and the seal 174 is in fluid communication with the passages 164 and 168 by passages 200 and 202 (FIGS. 8 and 14).

Accordingly, piston 176 in the static position is biased by an air spring created by the pressurized fluid communicated from the reservoir through the passage 199 to the position illustrated in FIG. 14. Once the tool is fired in the manner described above, pressurized fluid is communicated around the diaphragm 160 and through the conduits 162, 164, 168, 200 and 202 to the chamber 173, adjacent the retraction piston 178. Since the retraction piston 178 is of a larger cross-sectional area than the advance piston 180, the force developed by the pressurized fluid communicated by the passage 202 is sufficient to move the piston 176 to the position illustrated in FIG. 20 wherein the pawls 186 and 188 are moved into engagement with the apertures 190 and 192 behind the next fastener 26 to be fed in the drive track 32. At this point in the sequence of operation of the tool 10 the driver 62 is in the drive track 32 or is being retracted therefrom and it is not desired to advance the next fastener 26 into the drive track 32. Once the driver 62 has been completely retracted or returned to the static position, however, the passages 164, 168, 200 and 202 are removed from communication with pressurized air by the diaphragm 160. As a result, the pressurized fluid within the chamber 173 between the end of the cylinder 172 and the advance piston 180 creates a force that overcomes the force developed by the reduced pressure adjacent the retraction piston 178, thus moving the piston 176 to the position illustrated in FIG. 10. As this occurs, the next fastener 26 is advanced into the drive track 32 and the tool is ready for firing.

As previously described, the tool 10 may be employed to drive large fasteners 26 into a workpiece. In driving fasteners of this size, the tool 10 experiences a recoil that tends to lift the tool 10 off the workpiece. Two results can occur from this recoil. The first is that the workpiece engagement member 104 remains in contact with the workpiece but the tool 10 does not. This movement of the tool 10 relative to the workpiece engagement member 104 could result in trip firing or recycling of the tool 10. To avoid trip firing, the lost motion connection defined by the spring 124 between the lower 120 and upper 122 safety yokes is provided. This allows movement of the lower yoke 120 and the workpiece engagement member 104 without movement imparted to the upper yoke 122 since the spring 124 absorbs and compensates for this relative movement.

Figure 11:
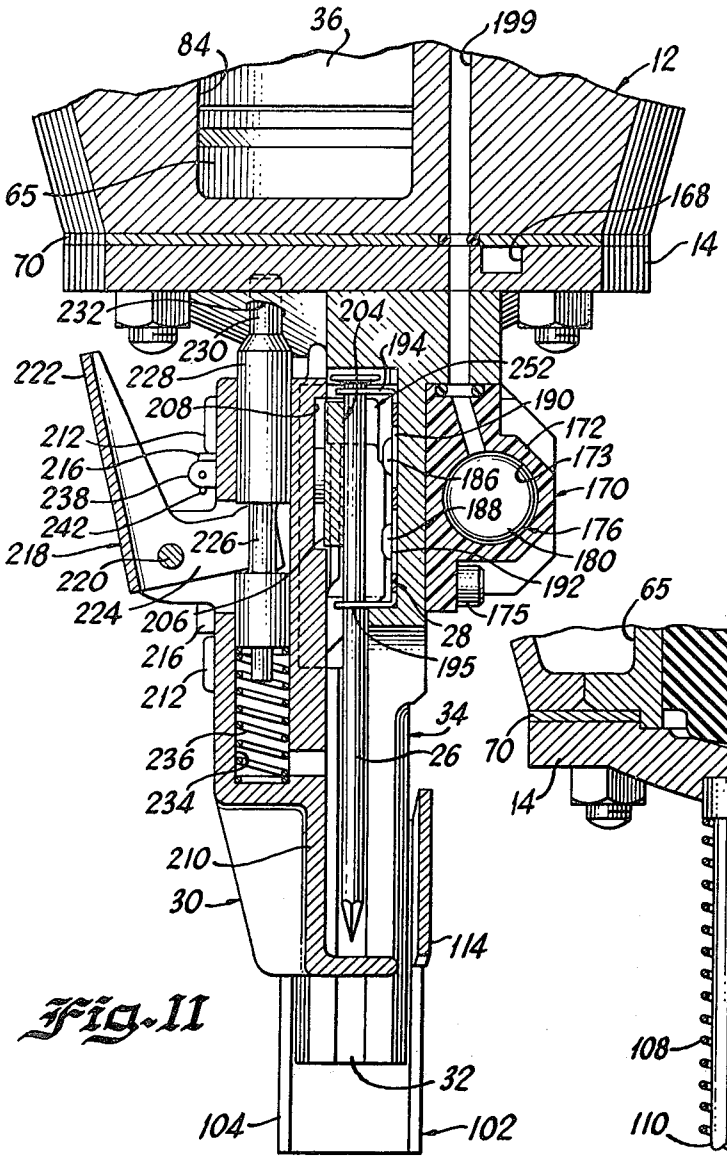
FIG. 11 is a view taken along line 11—11 of FIG. 1.
Figures 16, 17:
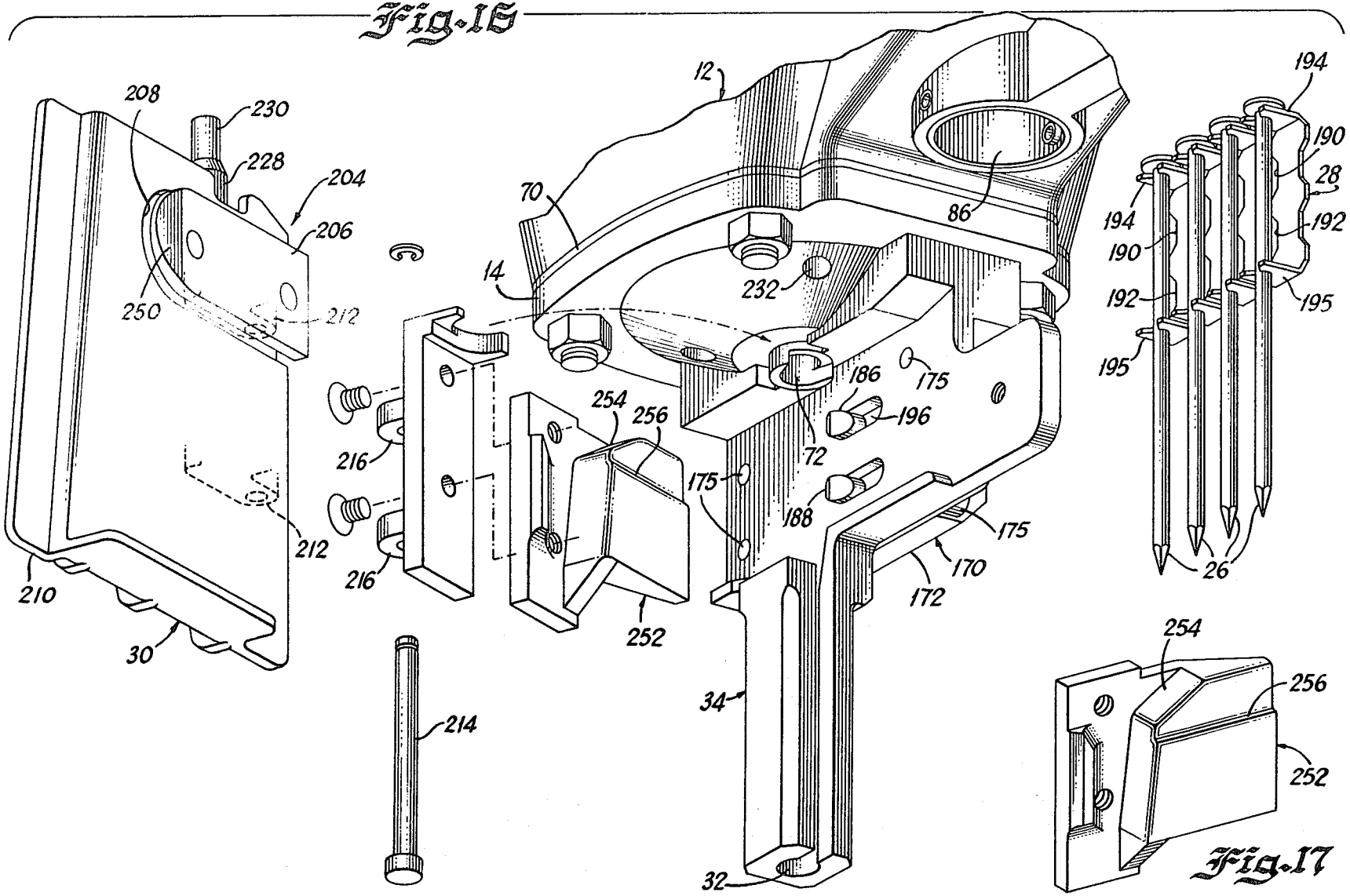
FIG. 16 is an enlarged exploded view of the fastener engagement portion of the tool of the present invention.
FIG. 17 is an enlarged perspective view of a tape guide employed in the tool of the present invention.

The second possible result of this recoil is that the fasteners 26 due to their size and weight and through the effect of inertia tend to be pulled downwardly away from the carrier strip 28 during this recoil. The carrier strip 28 includes upper 194 and lower 195 tabs that engage and hold the fasteners 26 to the carrier strip 28. To ensure that the fasteners 26 are not dislodged from the carrier strip 28 and specifically the upper tab 194, a fastener engagement assembly generally designated by the reference numeral 204 is provided (FIG. 16). The fastener engagement assembly 204 includes a shoe 206 mounted in a recess 208 defined in the door 210 of the gate assembly 30. The door 210 of the gate assembly is pivotally mounted on the nose 14 by hinges 212 (FIG. 1) that are connected by a pin 214 to hinges 216 defined on the drive track portion 34 of the tool 10. The door 210 of the gate assembly 30 is locked in a closed position by a latch 218 (FIG. 11) pivotally mounted to the nose 14 by a pin 220. The latch 218 includes a handle portion 222 that may be gripped by the operator and a leg 224 that engages a reduced portion 226 of a latch pin 228. The latch pin 228 includes a reduced upper end 230 that extends into an aperture 232 defined in the nose 14. A lower end of the latch pin 228 extends into a chamber 234 within which is positioned or mounted a spring 236 biasing the latch pin 228 upwardly into the aperture 232. By pivoting the latch 218 forwardly or clockwise as viewed in FIG. 11, about the pin 220, this moves the latch pin 228 downward and the upper end 230 of the pin 228 out of the aperture 232 thereby unlatching the gate door 210 and allowing it to be pivoted outwardly about the hinge pin 214. This allows access to the fasteners 26 on the carrier strip 28 to clear a jam or to thread the carrier strip 28 through the tool to the drive track 32.

The fastener engagement assembly 204 and specifically the floating shoe 206 as best seen in FIG. 10 is secured to the gate door 210 by a pair of pins 238 that extend through apertures 240 in the door 210 and are locked into position by pins 242. The shoe pins 238 include an enlarged portion 244 mounted within an enlarged bore 246 defined in the door 210 within which are positioned springs 248. The springs 248 provide a resilient bias on the pins 238 and provide the shoe 206 with a floating effect.

The forward edge 250 of the shoe 206 is beveled or slanted so as to engage advancing fasteners 26 to insure that the forward edge of the shoe 206 does not bind on the fasteners 26. In addition, the upper edge of the shoe 206 engages the lower edge of each upper tab 194 on the carrier strip 28 and the upper tab 194 and the head of each fastener 26 is supported such that during recoil, the fastener 26 is not dislodged from the carrier strip 28.

After each fastener 26 has been driven into a workpiece, the carrier strip 28 is advanced in the manner previously described. That portion of the carrier strip 28 from which a fastener has been driven is passed forwardly from the drive track 34 and outwardly from the driver track portion 34 of the tool 10. As the empty portion of the carrier strip 28 is advanced outward of the tool 10, the empty carrier strip 28 engages a tape guide 252 (FIGS. 16 and 17). The tape guide 252 includes a sloped surface 254 along which the tabs 194 can pass if the tabs 194 are pushed up or extend perpendicular to the carrier strip 28 and includes an undercut 256 that will engage the tab 194 if bent downwardly to allow the carrier strip 28 to pass out of the tool 10.

Turning now to FIGS. 22—24 for a more detailed description of the magazine assembly 22; as previously described, the magazine assembly 22 is defined by two identical housing portions 300 and 300A. Hereinafter, the components of the housing portion 300A will be designated by the numeral of the corresponding component on portion 300 and with a suffix "A". With specific reference to FIG. 24, the housing portion 300 in the preferred embodiment includes a generally semi-circular wall 302 that defines side, top and bottom walls of half of the magazine assembly 22. At the forward edge of the wall 302 is an extending lip 304 defining part of an opening 306 through which pass the fasteners 26 and carrier strip 28.

The semi-circular wall 302 defines an internal chamber 308 within which the strip 28 and fasteners 26 are contained during operation of the tool 10. The lower edge of the housing member 300 includes a groove 310, and the upper edge of the housing 302 includes a tongue member 312. Hinges 314 and 316 defined along the vertical back edge of the wall 302 and include central apertures 318 and 320 defined therein. In addition, on the upper surface of the wall surface 302 is a T-shaped portion 322 that is employed to attach the magazine assembly 22 to the tool 10.

The attachment of the magazine 22 to the tool 10 is best illustrated in FIG. 22 wherein the T-shaped portion 322 is captured by the bracket assembly 24 that is defined by brackets 324 and 326. The brackets 324 and 326 are secured to the tool by fasteners 328 and include flanges 330 and 332 that are positioned beneath the T-shaped portion 322 to hold the member 300 to the tool 10. Once this is accomplished, the other portion 300A of the magazine assembly 22 may be joined to the portion 300 by reversing the housing portion 300A and joining the hinges 314, 316, 314A and 316A as best illustrated in the FIG. 24. Once the hinges 314, 316, 314A, and 316A are interfitted, a pin 334 may be passed through the apertures 318, 320, 318A and 320A of the hinge members 314, 316, 314A and 316A. Thereafter, the portions 300 and 300A may be closed in a clam shell manner so that the tongue 312 is inserted into groove 310A and tongue 312A inserted into groove 310.

To provide torsional stability, a lever arm 336 is included with the tool 10. As illustrated in FIG. 22, the bracket members 324 and 326 include slots 338 and 340, respectively, and the lever arm 336 includes an end portion 342 that extends into slot 338 and a transverse portion 344 that is positioned between the brackets 324 and 326 (FIG. 23) and the remaining portion of lever arm 336 extends through the slot 340. The lever arm 336 includes a bend portion 346 and a flat arm portion 348 that engages the top of the portion 300A thus preventing torsional movement of the magazine 22 relative to the tool 10.

If the magazine 22 is hit during operation of the tool 10, and the T-shaped portion 322 damaged, it is a simple matter to reverse the magazine 22 and to place the T-shaped portion 322A in the brackets 324 and 326 thus allowing continued use of the magazine 22 and prolonging the life thereof.

Many modifications and variations of the present invention are possible in light of the above teachings. Thus, it is to be understood that, within the scope of the appended claims, the invention may be practiced other than as specifically described above.

What is claimed and desired to be secured by Letters Patent of the United States is:

1. In a fastener driving tool including a housing defining a reservoir for pressurized fluid, a nose portion and a handle portion, a driver mounted in said nose portion, means for driving said driver through a driving stroke, the improvment comprising means for returning said driver to a static position, said returning means comprises a chamber, first and second inlets in said chamber, said first and second inlets in fluid communication with said reservoir, a diaphragm mounted in said chamber and sealing said first inlet, and a first outlet in said chamber in fluid communication with said nose portion below said driver, said diaphragm separates said first inlet and said outlet from said second inlet and controls fluid flow therethrough.

2. The tool set forth in claim 1 further comprising orifice means in said second inlet for metering said pressurized fluid into said chamber.

3. The tool set forth in claim 1 further comprising means for communicating said second inlet with fluid of a lesser pressure than said pressurized fluid, said communicating means being sealingly closed by said driver in said static position.

4. The tool set forth in claim 1 further comprising a valve housing for said returning means detachably mounted on said housing of said tool, and trigger means for actuating said driving means, said trigger means defined in said valve housing.

5. In a fastener driving tool of the type including a body defining a reservoir for pressurized fluid and a nose portion, a driver mounted in said nose portion, a piston secured to said driver and means for driving said driver, a driver return assembly comprising means for supplying said pressurized fluid beneath said piston, and first means for communicating said pressurized fluid to said piston at the completion of a driving stroke of said driver, said first communicating means including a resilient valve member elastically controlled by fluid pressure to supply pressurized fluid beneath said piston and to terminate the flow thereof and fluid pressure control means for controlling the flow of fluid pressure to actuate said resilient valve member.

6. The tool claimed in claim 5 wherein said supplying means comprises a chamber, a first inlet in said chamber in fluid communication with said reservoir, and a first outlet in said chamber in fluid communication with said piston.

7. The tool claimed in claim 6 wherein said valve member comprises a resilient diaphragm sealingly engaging said first inlet and said first outlet.

8. The tool claimed in claim 6 wherein said fluid pressure control means comprises a second inlet in said chamber in fluid communication with said reservoir, and metering means in said second inlet for metering pressurized fluid through said second inlet and venting means for venting said chamber through said second inlet and said metering means.

9. The tool claimed in claim 8 further comprising second means for communicating said second inlet with atmospheric pressure, said second communicating means being sealed by said piston secured by said driver in a static mode of said tool.

10. The tool claimed in claim 5 further comprising a housing for said supplying means removably secured to said body, and trigger means for actuating said driver means defined in said housing.

11. A return assembly for returning a driver of a fastener driving tool to a static position comprising a return assembly housing removably secured to said tool, a chamber defined in said housing, first and second inlet means for communicating said chamber with a source of pressurized fluid, fluid flow restriction means for restricting the flow of pressurized fluid through said first inlet means, third inlet means for communicating fluid at atmospheric pressure to said chamber, first outlet means for communicating said chamber with a portion of said tool below said driver at the completion of a fastener driving stroke, and a resilient diaphragm mounted in said chamber and sealing said second inlet means and said first outlet means and responsive to pressure within said chamber introduced by said first and third inlet means to control fluid flow between said second inlet means and said first outlet means.

12. The assembly set forth in claim 11 wherein said driver controls the communication of said third inlet means with said fluid at atmospheric pressure.

13. The assembly set forth in claim 11 wherein said fluid flow restriction means comprises an orificed plug.

* * * * *